United States Patent [19]

Menchetti

[11] Patent Number: 4,897,978

[45] Date of Patent: Feb. 6, 1990

[54] PANEL EDGE ALIGNMENT CLIP

[75] Inventor: Robert J. Menchetti, Buffalo, N.Y.

[73] Assignee: National Gypsum Company, Dallas, Tex.

[21] Appl. No.: 273,524

[22] Filed: Nov. 21, 1988

[51] Int. Cl.[4] ..... E04F 13/04

[52] U.S. Cl. ..... 52/363; 52/285; 52/714

[58] Field of Search ..... 52/580, 584, 281, 127.1, 52/285, 363, 483, 484, 509, 714, 807

[56] References Cited

U.S. PATENT DOCUMENTS

| | | | |
|---|---|---|---|
| 2,697,262 | 12/1954 | Olsen | 52/285 X |
| 2,959,896 | 11/1960 | Schneller | 52/285 |
| 3,280,771 | 10/1966 | Burklo et al. | 52/714 X |
| 4,117,644 | 10/1978 | Weinar | 52/363 X |
| 4,569,172 | 2/1986 | Weinar | 52/281 |
| 4,584,808 | 4/1986 | Wendt | 52/363 X |
| 4,679,370 | 7/1987 | Samuelson | 52/407 |

*Primary Examiner*—David A. Scherbel
*Assistant Examiner*—Creighton Smith
*Attorney, Agent, or Firm*—Laird F. Miller; Robert F. Hause

[57] ABSTRACT

A hollow wall having a V-shaped rigid wire clip with two almost parallel legs engaged in holes in a metal element on a wallboard back face, with the clip head extending across the wallboard edge joint, to hold abutting wallboard edges coplanar, in which at least one of the clip legs has an intermediate bend engaging the hole periphery, whereby a thin tool, extended through the joint, can rotate the clip head around the intermediate bend, which is engaged with the hole periphery, which removes the clip head from behind one of the two abutting edges, for nondestructive removal of one of the wallboards of the wall.

20 Claims, 2 Drawing Sheets

PANEL EDGE ALIGNMENT CLIP

BACKGROUND OF THE INVENTION

This invention relates to a wire clip for holding abutting wallboard edges in coplanar alignment and to a method and combination, wherein the clip is inserted into a pair of openings in a metal structural element located in spaced parallel relationship to a wallboard edge.

Generally, when a plurality of wallboards are vertically mounted in coplanar relationship to form a vertical wall, the wallboards are affixed to vertical studs, at least some of which studs are located behind each pair of abutting wallboard edges, thus maintaining the wallboard edges in a firm, fixed coplanar relationship. The wallboard edges are commonly affixed to the vertical studs by nails, screws or possibly by concealed metal clips which are attached to the studs, as in U.S. Pat. No. 4,117,644.

U.S. Pat. No. 2,697,262 discloses a wire clip intended for holding edges of sheets of lath in coplanar relationship, in structures where the edges are not located over a stud, however, the form of clip disclosed therein is like a paper clip, with portions of the clip disposed on both the back faces of the abutting lath sheets and on the front faces. This is not objectionable for sheets of lath since the intent is to cover the front faces of the lath sheets with a thick coating of plaster, to form a plaster wall.

U.S. Pat. No. 4,679,370 discloses a wall system in which there is no stud located immediately behind the wallboard joint and in which a special sheet metal plate 39 is employed to lockingly engage in slits 17" in the U-shaped profiles 3" of two abutting wallboards 1, and apparently maintain the wallboard edges coplanar.

SUMMARY OF THE INVENTION

The present invention is directed to an easily removable wire clip for disposition behind an otherwise unsupported pair of abutting wallboard edges, for use with wallboards having an element on the back face with pairs of closely spaced openings for receiving the two ends of the wire clip.

The invention is directed primarily to the erection of wall systems having integral wallboards and elongate metal stud units, wherein the integral studs are adhered to the wallboard back face, closely spaced from and parallel to the wallboard edges. A plurality of small holes are located along the integral stud, preferably at a fold line of the integral stud, whereat the holes also perform the function of assisting in accurate bending of the integral stud. The novel wire clips have a U- or V-shape, and are uniquely formed to engage a pair of the small holes, and to interlock with the integral stud in a way which fixes the clip position relative to the board edge but permits easy rotation of the clip by a knife-like tool inserted through a wallboard joint, rotation between a functional position and a nonfunctional position, for easy nondestructive removal of any single wallboard from the finished wall.

It is an object of the invention to provide a novel clip for repeated nondestructive engagement and disengagement behind a pair of abutting wallboards to maintain a coplanar relationship between wallboards, when engaged by clips, and to permit easy removal of wallboards, when the clips are disengaged.

It is a further object to provide such a clip in a form which is readily adaptable for use in combination with integral wallboard and metal stud units.

It is a still further object to provide a wall structure in which the wallboard panel edges are held in firm coplanar relationship by wire clips which are easily rotated to a disengaged position whereat the clips permit nondestructive removal and replacement of a single wallboard in the wall structure.

BRIEF DESCRIPTION OF THE DRAWINGS

These and other objects and advantages will be more readily apparent when considered in relation to the preferred embodiments of the invention as set forth in the specification and shown in the drawings in which.

DESCRIPTION OF THE PREFERRED EMBODIMENTS

Figure 1:
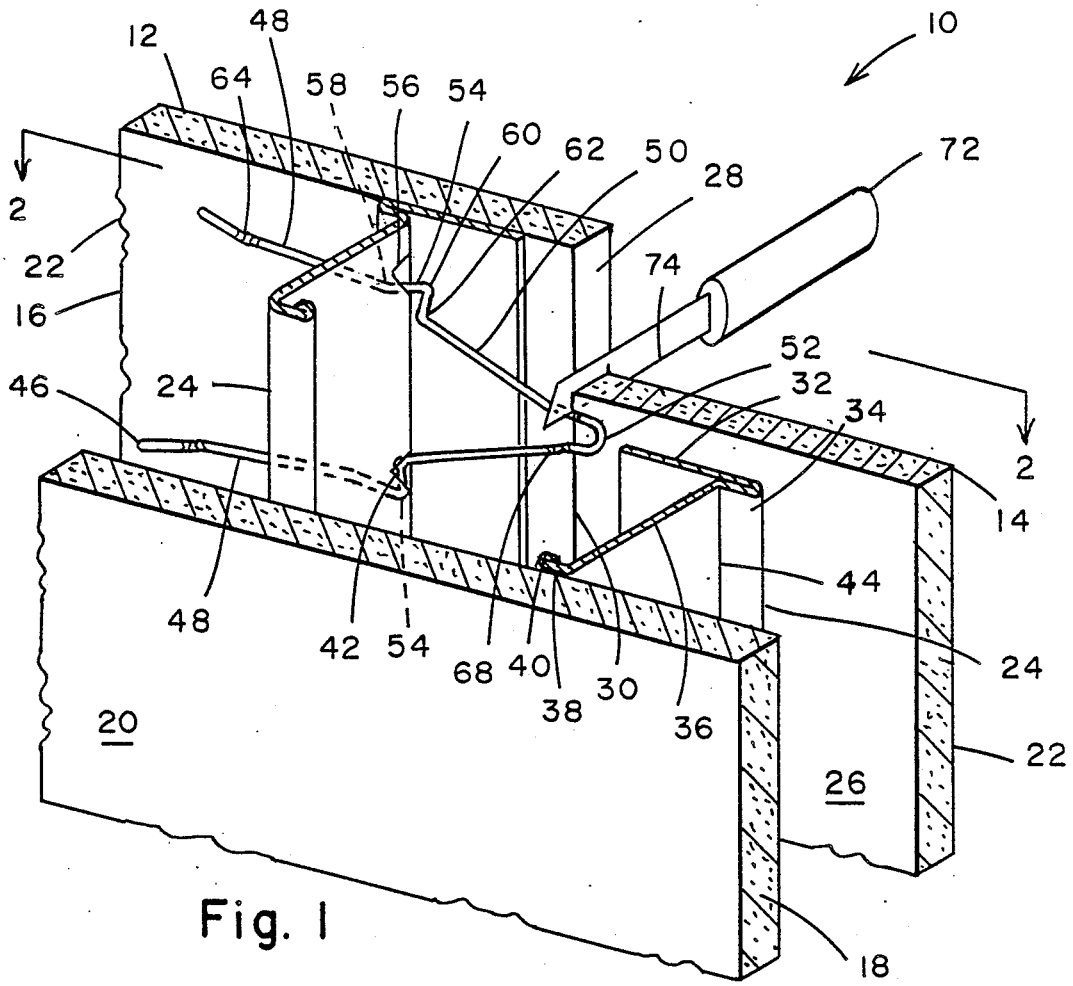
FIG. 1 is an isometric top view of a cross section of a hollow partition wall including a pair of integral wallboard and metal stud units at a joint thereof with one of the novel wire clips rotatably affixed within a pair of holes in the metal stud element of one unit and extending onto the back face of a wallboard of the abutting unit.
Figure 2:
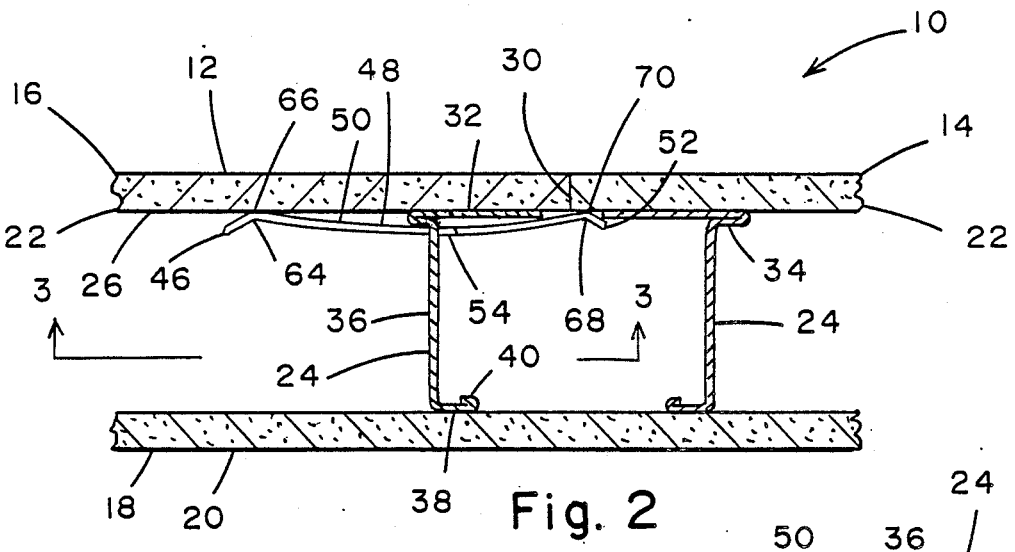
FIG. 2 is a top cross-sectional view of the wall of FIG. 1 on line 2—2, omitting the tool.
Figure 3:
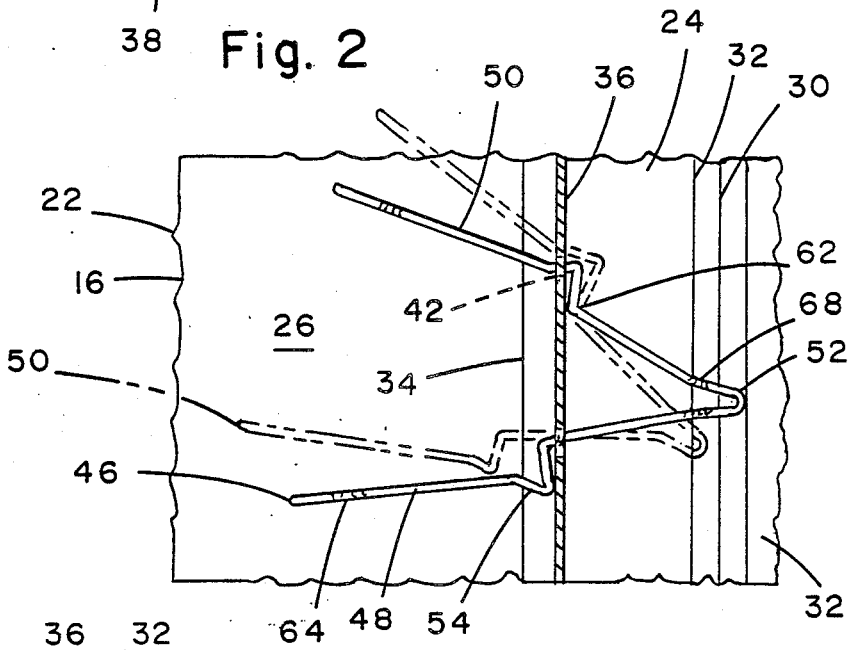
FIG. 3 is a cross-sectional view of the wall of FIG. 2 taken on line 3—3, also showing the clip rotated to a disengaged, nonfunctional position.

Referring to FIGS. 1, 2 and 3, there is shown a portion of a hollow partition wall 10, including, on a first face 12 of wall 10, an integral wallboard and metal stud unit 14, a second coplanar integral wallboard and metal stud unit 16 and a wallboard 18, which is also a central portion of an integral wallboard and metal stud unit, disposed on the opposite face 20 of wall 10.

Each wallboard and metal stud unit 14 and 16 includes a wallboard 22, such as ½-inch thick, four-foot wide and ceiling height paper covered gypsum boards, and an elongate sheet metal stud element 24, adhered onto the back face 26 of wallboard 22 closely spaced from and parallel to, each vertically extending side edge 28. Only one of the two side edges 28 of each unit 14 and 16 is shown, and thus only one of the two metal stud elements 24 of each unit 14 and 16 is shown.

The side edges 28 of each of the two units 14 and 16 which are shown will be seen to form a wallboard joint 30, whereat the two wallboards 22 of units 14 and 16 are coplanar and have side edges 28 which are abutting, or very closely spaced.

The metal stud elements 24, are formed of an elongate strip of sheet metal which has elongate folds which result in the stud elements 24 including, in cross section, a flat base 32, a narrow return 34 connected to base 32 by a 180° fold, a web 36, the width of which determines the thickness of the hollow wall 10, and a flange 38 which has a narrow hem 40. Web 36 extends perpendicularly from return 34, and flange 38 extends perpendicularly from web 36.

In the preferred form, diamond shaped holes 42 are located in the web 36 at the fold 44 which adjoins web 36 and return 34. Holes 42 are about ½ inch in length and about ⅜ inch in width, with the long dimension extending along fold 44. Holes 42 are located at about 2-½ inch spacings, center-to-center, along the full length of metal stud element 24.

The metal stud element 24 is preferably adhered to wallboard 22 in a factory with the return 34 and the web 36 still in a single plane, for more compact shipping to a job site. Just prior to erection of the wall 10, the web 36 is bent 90° relative to return 34, along fold 44. One function of the diamond shaped holes 42 is to assist in making fold 44 along the desired location, as shown.

A second function of the holes 42, in accordance with the invention, is to receive, in a pair of spaced holes 42, preferably adjacent holes 42, the two closely parallel ends 46 of the two legs 48 of a panel edge alignment clip 50. Clip 50 is formed of about 0.1 inch diameter, relatively rigid, tempered wire, in a somewhat V-shaped or U-shaped form, and includes essentially the two legs 48 and a head 52, whereat the two legs 48 are adjoined.

In the V-shaped clip 50, shown in the drawings, each leg 48 includes, at some intermediate point, an intermediate bend 54 of sufficient magnitude to engage the metal periphery 56 of the holes 42 for the functional purpose as will be described herebelow. In the preferred embodiment shown, each intermediate bend 54 includes three alternating bends 58, 60, 62, resulting in intermediate bend 54 being an outwardly extending bow in the wire, all substantially within what is the general plane of the V-shaped clip 50, which plane is parallel to the board back face 26. Preferably, bend 58 is about 150°, bend 60 is about ½ inch away and is about 60°, and bend 62 is about ½inch away and is about 90°.

Each clip leg 48 also includes a foot bend 64, which-is in a plane perpendicular to the general plane of the clip 50. The foot bend 64, on each leg 48, is approximately ½ inch from the end 46, and provides a relatively smooth, slidable bent surface 66 which rests against the back face 26 of wallboard 22 of unit 14, when the clip 50 is engaged in the holes 42.

Each clip leg 48 also includes a head bend 68, which is also in a plane perpendicular to the general plane of the clip 50. The head bend 68, on each leg 48, is approximately ¾ inch from the head 52, where the two legs 48 are adjoined. The head bends 68 provide a relatively smooth slidable bent surface 70, which rests against the back face 26 of wallboard 22 of unit 16, when the clip 50 is engaged in the holes 42, and the clip is in a panel edge aligning position When clip 50 is originally inserted into the holes 42, during erection of the wall 10, the two ends 46 are first inserted in two holes 42, the intermediate bend of one of the legs 48, preferably the lower of the two legs 48, is then shoved until the intermediate bend 54 is completely through the one hole 42, and then the other leg 48 is shoved into the other hole 42 until the intermediate bend 54 thereof is partially through the hole 42. The clip 50 is then in a functional panel edge aligning position, as shown in the drawings The dimensions of the clip 50 are such that the clip extends across the back of joint 30, from behind unit 14 to behind unit 16, disposed firmly against the back faces 26 of the wallboards 22 of both units 14 and 16, when the clip is in a functional panel edge aligning position, as shown in the drawings.

Referring now to FIG. 3, a clip 50 is shown in a functional panel edge aligning position, with the head 52 extending across joint 30, and thus held firmly against the back faces 26 of two abutting wallboards 22. Also shown, in phantom, is the clip 50 after it has been rotated to a nonfunctional position, where it is held firmly, still, by its engagement in two holes 42, but it is now held firmly against the back face 26 of only one wallboard 22.

Also shown in FIG. 1 is a tool 72, such as a thin bladed knife, extending through joint 30 with the blunt edge 74 disposed against the head 52 of clip 50, in a position preparatory to rotating the head 52 downward, as shown by the phantom view of the clip in FIG. 3. When clip 50 is rotated downward to a nonfunctional position, this clip 50 will no longer prevent the removal of the wallboard and metal stud unit 14 from being removed from the wall 10.

Figure 4:
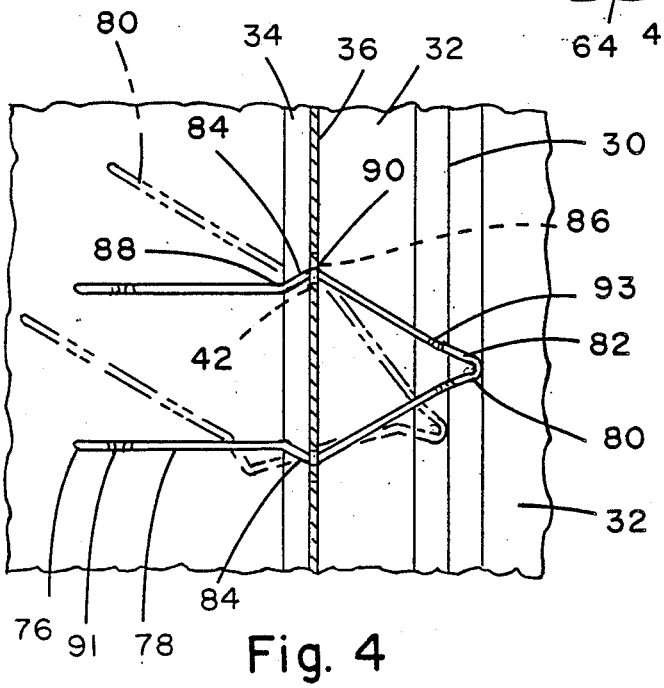
FIG. 4 is a cross-sectional view similar to FIG. 3 showing a modified form of the novel clip.

FIG. 4 is a view similar to FIG. 3 with a modified form of the invention in which the ends 76 of legs 78 of modified panel alignment clip 80 are inserted through the holes 42. Clips 80 have a relatively U-shaped head 82, whereat the two legs 78 are adjoined. Each leg 78 includes an intermediate bend 84 of sufficient magnitude to engage the metal periphery 86 of the holes 42.

Each intermediate bend 84 includes two alternating bends 88, 90, resulting in intermediate bend 84 being an outwardly extending step, proceeding from the clip ends 76 toward the head 82, all substantially within the general plane of the U-shaped clip 80.

Each clip leg 78 also includes a foot bend 91, which is in a plane perpendicular to the general plane of the clip 80, and also a head bend 93, in a plane perpendicular to the general plane of the clip 80, each of which function similar to foot bend 64 and head bend 68, respectively.

The intermediate bends 84 of legs 78 are located adjacent the periphery 86 of their respective holes 42, to function generally similar to intermediate bends 54 of clip 50, during rotation of the clip 80.

Figure 5:
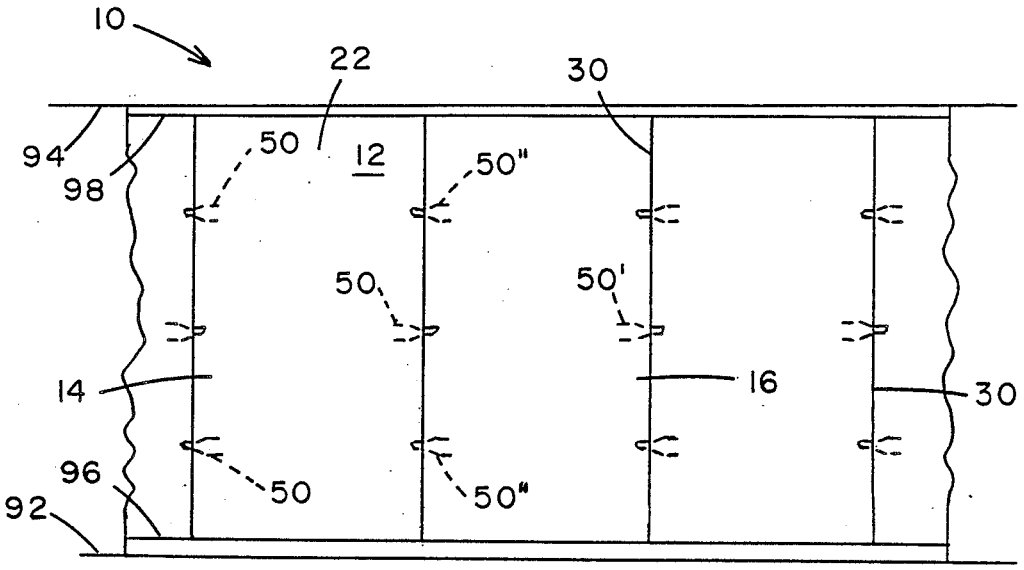
FIG. 5 is a face view of the wall of FIG. 1 showing a plurality of wallboard joints with a plurality of invisible clips indicated thereon in a preferred positioning of the clips in a wall.

FIG. 5 is a face view of the wall 10 showing a plurality of wallboards and metal stud units including units 14 and 16, extending from a floor 92 to a ceiling 94, with the bottom and top portions of the several units concealed by an elongate base trim strip 96 and an elongate ceiling trim strip 98, respectively.

The locations of the clips 50 on each of the wallboard and metal stud units, including units 14 and 16, is, in all cases here shown, two clips 50 extending leftward from the left edge of each unit, one about two feet up from the floor 92 and one about two feet down from the ceiling 94, and one clip 50 extending rightward from the right edge of each unit, at about the halfway point between the floor 92 and the ceiling 94. This placement of clips 50, or, alternatively, of clips 80, provides an adequate panel alignment function, maintaining the abutting wallboard edges at each joint 30 in firm coplanar relationship.

Removal and subsequent replacement of any one unit, such as unit 16, can be easily and readily accomplished, without any damage, by removing floor and ceiling trim strips 96, 98 and rotating the one clip 50′ on the right edge, located halfway up the wall 10, to a downward, nonfunctional position, using a knife. The right side of the unit 16 is then free to be pulled away from the wall 10. Unit 16 can then be moved toward the right, to disengage the clips 50" from behind the wallboard of unit 14, and unit 16 is removed. Replacement involves a reversal of these removal steps.

In replacing the unit 16, the clip 50′ is rotated to a position such that the head 52 can be moved past the adjacent wallboard edge while still being accessible to be rotated back upwardly, using the blunt back edge of a knife 72 to accomplish this rotation. The V-shaped clip 50 is somewhat easier to engage with a knife and rotate during replacement than the U-shaped clip 80.

The upper intermediate bends 54 and 84 will be seen to function to permit pivoting of the clips 50 and 80 around the upper intermediate bend 54 or 84 when disengaging downwardly and reengaging upwardly. The lower intermediate bends 54 or 84 provide a somewhat less essential function of a stop means for indicating when the clip 50 or 80 is in the proper functional position, during reengagement.

Having completed a detailed disclosure of the preferred embodiments of my invention so that those skilled in the art may practice the same, I contemplate that variations may be made without departing from the essence of the invention.

I claim:

1. A panel edge alignment clip comprising a single length of relatively rigid wire formed to include two somewhat parallel legs engageable in holes in a rigid building framing element, which said framing element has a pair of spaced apart small holes of a size larger than said wire's size, and a head whereat said two legs are adjoined, each said leg having a foot end portion and a head end portion and therebetween an intermediate portion, said intermediate portions of said two legs all lying within a single general plane, at least one of said legs having an intermediate bend within said intermediate portion of sufficient magnitude to engage the periphery of one of said pair of holes when said legs are extended through said spaced apart small holes, and to thereby cause rotation of the clip head around said intermediate bend when said head is caused to move within said general plane of said clip.

2. A panel edge alignment clip, as defined in claim 1, wherein said two legs each include an intermediate bend.

3. A panel edge alignment clip, as defined in claim 1, wherein said intermediate bend includes at least two alternating bends which are both in said general plane of said clip.

4. A panel edge alignment clip, as defined in claim 1, wherein said two legs each have a foot bend and a head bend, said foot bends being at said foot end portions and said head bends being at said head end portions, said foot bends and said head bends being in a plane substantially perpendicular to said general plane of said clip, providing slidable bent surfaces.

5. A panel edge alignment clip, as defined in claim 1, wherein said two legs each include an intermediate bend which includes three alternating bends.

6. A hollow wall comprising a plurality of wallboards forming a first face of said wall, said wallboards of said first face being all in coplanar relationship, said wallboards all having vertically extending side edges which abut vertically extending side edges of an adjacent wallboard and thereby form a wallboard edge joint of coplanar wallboard edges, at least one opposing pair of panel edge alignment clips disposed behind a pair of abutting side edges at each said edge joint, said clips each comprising a single length of relatively rigid wire formed to include two somewhat parallel legs engageable in holes in a rigid building framing element, which said framing element has a pair of spaced apart small holes of a size larger than said wire's size, and a head whereat said two legs are adjoined, each said leg having a foot end portion and a head end portion and therebetween an intermediate portion, at least one of said legs having an intermediate bend within said intermediate portion of sufficient magnitude to engage the periphery of one of said pair of holes when said legs are extended through said spaced apart small holes, and to thereby cause rotation of the clip head around said intermediate bend when said head is caused to move within said general plane of said clip, means for receiving and holding said two legs of each of said clips disposed in fixed relationship to one of said wallboards on a back face of each said wallboard, said means for receiving and holding said legs of said clips being a pair of holes in a metal element which permits relative movement of said clip wire through said hole, said intermediate bend in said one leg of said clip being disposed at one of said holes and being so engaged with said metal element that movement of said clip head within said plane of said clip will result in a rotation of said clip head around said intermediate bend and will result in sliding of said clip leg, which is not engaged with said metal element, through the respective said hole through which said non-engaged leg extends.

7. A hollow wall, as defined in claim 6, wherein said wall further includes a plurality of wallboards forming a second face of said wall in spaced parallel relationship to said first face.

8. A hollow wall, as defined in claim 6, wherein there are at least three of said panel edge alignment clips disposed behind each said edge joint.

9. A hollow wall, as defined in claim 6, wherein said means on each wallboard for receiving and holding said two legs of said clips is an elongate sheet metal stud element adhered onto said back face of each said wallboard, each said wallboard having one of said stud elements adhered to said back face along an area of said back face which is parallel to and spaced closely from each said vertical side edge of said wallboard, and wherein said stud element includes an elongate 90° fold, with small, spaced holes at said fold, said fold being disposed closely adjacent the plane of said wallboard back face.

10. A hollow wall, as defined in claim 6, wherein said two clip legs each include an intermediate bend disposed at said pair of holes.

11. A hollow wall, as defined in claim 6, wherein said intermediate bends each include three alternating bends.

12. A hollow wall, as defined in claim 11, wherein said alternating bends of said clip wire are all within said general plane of said clip and said general plane of said clip is parallel to said wallboard back face.

13. A hollow wall, as defined in claim 12, wherein said alternating bends are at about ½ inch spacings.

14. A hollow wall, as defined in claim 13, wherein one of said intermediate bends is disposed partway through a hole and the other of said intermediate bends is disposed completely through a hole, whereby rotation of said clip head toward the leg with an intermediate bend completely through a hole will result in pivoting said clip about said intermediate bend which is partway through a hole.

15. A hollow wall, as defined in claim 14, wherein said clip is formed of about 0.1 inch diameter relatively rigid wire.

16. A hollow wall, as defined in claim 6, wherein said two legs of each of said clips each have a foot bend and a head bend, said foot bends being at said foot end portions and said head bends being at said head end portions, said foot bends and said head bends being in a plane substantially perpendicular to said general plane of said clip, forming slidable bent surfaces abutting the wallboard back faces.

17. The method of removing a selected wallboard in a wall, as defined by claim 6, comprising the steps of inserting a thin knife-like tool through one of said edge joints, moving said tool vertically until said tool contacts one of said clips, pushing said clip vertically and thereby causing said clip to rotate around said intermediate bend which is engaged in one of said holes on said selected wallboard back face, rotating said clip until said clip is no longer disposed behind more than said selected wallboard, repeating said steps as necessary with any additional said clips that may be mounted on said selected wallboard first vertical edge, and moving said selected wallboard edge away from said wall and away from said selected wallboard opposite vertical edge, thereby completely removing said selected wallboard from said wall.

18. The method of removing a selected wallboard, as defined in claim 17, wherein said clip upper leg has an intermediate bend including three alternating bends which are coplanar with said clip general plane, and wherein said clip upper leg intermediate bend is partway through a hole, wherein said tool is pushed downward against said clip, rotating said clip head downward, and causing said clip lower leg to be pushed further into a hole.

19. The method of removing and replacing a selected wallboard, comprising the steps of removing a selected wallboard, as defined in claim 17, and further comprising the steps replacing said selected wallboard, wherein said selected wallboard opposite vertical edge is first replaced, said selected wallboard first vertical edge is then replaced, and then inserting said tool through said one edge joint to contact the opposite side of said clips and rotating said clips back to original position behind two wallboard edges.

20. The method of removing and replacing a selected wallboard, as defined in claim 19, wherein said clip upper leg has an intermediate bend including three alternating bends which are coplanar with said clip general plane, and wherein said clip upper leg intermediate bend is partway through a hole, wherein said tool is pushed downward against said clip, rotating said clip head downward, and causing said clip lower leg to be pushed further into a hole.

* * * * *